United States Patent [19]

Metz et al.

[11] Patent Number: 4,924,751

[45] Date of Patent: May 15, 1990

[54] GUN BARREL RECOIL BRAKE WITH THROTTLED COUNTERRECOIL

[75] Inventors: Josef Metz, Neuss; Hans Hülsewis, Ratingen, both of Fed. Rep. of Germany

[73] Assignee: Rheinmetall GmbH, Düsseldorf, Fed. Rep. of Germany

[21] Appl. No.: 364,228

[22] Filed: Jun. 12, 1989

[30] Foreign Application Priority Data

Jul. 16, 1988 [DE] Fed. Rep. of Germany ..... 3824153

[51] Int. Cl.[5] ..... F41F 19/02; F16F 9/10

[52] U.S. Cl. ..... 89/43.01; 188/316

[58] Field of Search ..... 89/43.01; 188/312-317

[56] References Cited

U.S. PATENT DOCUMENTS

| | | | |
|---|---|---|---|
| H217 | 2/1987 | Jorczak | 89/43.01 |
| 3,410,174 | 11/1968 | Hahn | 89/43.01 |
| 3,745,880 | 7/1973 | Metz et al. | 89/43.01 |
| 4,485,722 | 12/1984 | Metz et al. | 89/43.01 |
| 4,502,366 | 3/1985 | Metz et al. | 89/43.01 |
| 4,587,882 | 5/1986 | Metz et al. | 89/43.01 |

FOREIGN PATENT DOCUMENTS

| | | | |
|---|---|---|---|
| 0423490 | 1/1924 | Fed. Rep. of Germany . | |
| 735887 | 5/1943 | Fed. Rep. of Germany | 89/43.01 |
| 1231005 | 9/1960 | France | 89/43.01 |

*Primary Examiner*—David H. Brown

*Attorney, Agent, or Firm*—Spencer & Frank

[57] ABSTRACT

A hydraulic recoil brake for damping both recoil and counterrecoil of a gun barrel when used with a pneumatic recuperator on the breech ring for the gun barrel. The brake has an axially extending brake cylinder fixed to the breech ring in which are disposed a fixed fluid stream control rod, and a brake piston reciprocally axially movable relative to the control rod for resisting a flow of hydraulic fluid in said brake cylinder therepast during recoil. A piston ring which is axially reciprocally displaceable on the break piston between a first and second positions is engaged by a compression spring which elastically urges the piston ring to the second position after recoil. Brake pressure from the hydraulic fluid urges the piston ring into the first position against the force of the spring during a recoil. The piston ring has an axial bore which damps the counterrecoil by resisting a flow of hydraulic fluid therepast when the piston ring is in the second position. A face of the brake piston abuts an end of the bore to render it ineffective for damping when the piston ring is in the first position. The piston ring additionally serves to render damping by the control rod ineffective during counterrecoil by blocking connecting channels formed in the brake piston which connects brake chamber formed between the inner surface of the brake cylinder and the brake piston, and a throttle chamber between the piston rod of the brake piston and the control rod.

18 Claims, 4 Drawing Sheets

GUN BARREL RECOIL BRAKE WITH THROTTLED COUNTERRECOIL

BACKGROUND OF THE INVENTION

The present invention relates to a hydraulic gun barrel brake including a pneumatic gun barrel recuperator which is moved jointly with the recoil brake by way of a breech ring of a gun barrel.

It is known that in heavy weapons systems, for example in guns, the recoil velocity of the gun barrel is controlled by means of a throttling rod built into the recoil brake. Such a recoil brake is disclosed in German Patent No. 1,283,706. DE-AS No. 2,053,098 also discloses the throttling of the counterrecoil velocity of the gun barrel by means of a throttling device disposed in a separate recuperator.

Due to the respective arrangement of a recoil throttle in the recoil brake and a counterrecoil throttle in the recuperator, considerable manufacturing costs result in the production of both devices. For example, the throttling of the counterrecoil movement within the recuperator requires, in addition to the provision of a gas pressure chamber, also a complicated hollow recuperator cylinder filled with hydraulic fluid and an additional throttle valve. Due to the arrangement of the fluid throttle within the recuperator whose external dimensions are given, the internal gas volume is subjected to an increased pressure level and greater pressure fluctuations, thus possibly resulting in increased wear of the seals and thus also in increased maintenance costs.

The use of maintenance friendly seals is possible according to U.S. Pat. No. 4,587,882, but in this hollow cylinder no defined counterrecoil velocity can be set for greatly varying recoil lengths as they occur with weapons that fire at high angles. However, the realization of a uniform counterrecoil velocity is necessary for trouble-free operation of the weapon mechanism.

SUMMARY OF THE INVENTION

It is therefore an object of the present invention to improve the brake and recuperator system of a gun barrel composed of a separate brake cylinder and a separate recuperator cylinder so that the components in the recuperator are reduced and its readiness for use and reliability are increased, with a given counterrecoil velocity being realized even with varying recoil lengths.

This is accomplished by providing a hydraulic recoil brake to accompany a recuperator on the breech ring which provides damping of both recoil and counterrecoil of a gun barrel. The brake has a piston ring which is axially reciprocally displaceable on the break piston and is engaged by a spring which elastically urges the piston ring to a position after a recoil in which an axial bore in the piston ring damps the counterrecoil by resisting a flow of hydraulic fluid therethrough. Brake pressure from the hydraulic fluid urges the piston ring into an opposite position against the force of said spring during a recoil where a face of the brake piston abuts an end of the bore to render it ineffective for damping. The piston ring additionally serves to render damping by the control rod ineffective during counter-recoil by blocking connecting channels formed in the brake piston which connect a brake chamber formed between the inner surface of the brake cylinder and the brake piston rod, and an elongated throttle chamber between the brake piston rod and the control rod.

By placing the counterrecoil damping means into the recoil brake, the recuperator can be constructed much more simply and more economically. The recuperator is now composed of only a cylinder and a piston rod including a piston and the associated seals. With the same given total volume for the recuperator, a large gas volume is available with the advantages of a flat compression characteristic, particularly in view of the service life of the seals.

The arrangement according to the invention of an axially displaceable piston ring on the brake piston of the recoil brake makes it possible in a simple manner during recoil of the gun barrel that only the passage openings required to throttle the recoil are opened and they are closed immediately when the gun barrel switches to counterrecoil. At the same time that the gun barrel switches to counterrecoil, the means for damping the counterrecoil become effective in that at least one bore is opened which is arranged axially parallel within the piston ring and has a constant throttling cross section. Thus, additional throttling devices for the counterrecoil of the gun barrel are no longer needed in the recuperator.

Moreover, the constant throttling cross section ensures a uniform movement whose velocity can be predetermined as it is required for operational and mechanical functioning of the weapon.

The movements of the piston ring, which acts as a blocking slide, are limited on one side by a piston head releasably connected with a brake piston. The releasability of the piston head ensures easy installation of the piston ring on the brake piston.

For the process of closing the passage bores required, on the one hand, for the braking process and, on the other hand, for the counterrecoil movement, no additional seals are needed at the piston ring because the end and guide faces of the piston ring and the contacting faces of the brake piston are configured as sealing faces.

A further advantage of the gun barrel recoil and counterrecoil system according to the invention is that it is possible to effect positive throttling of the counterrecoil velocity even with different recoil lengths. For this purpose, a further feature of the invention provides that the control rod is equipped with throttling grooves of different lengths, with the piston ring only being able to block or release, respectively, throttling grooves of the same length. This possibility of making adjustments offers an advantageous possibility for installation in high-angle firing weapons which require different recoil lengths as a function of their fire height.

BRIEF DESCRIPTION OF THE DRAWINGS

These and other features and advantages of the invention will be more completely understood from the following detailed description of the preferred embodiments with reference to the accompanying drawings in which.

DETAILED DESCRIPTION OF THE PREFERRED EMBODIMENTS

Figure 1:
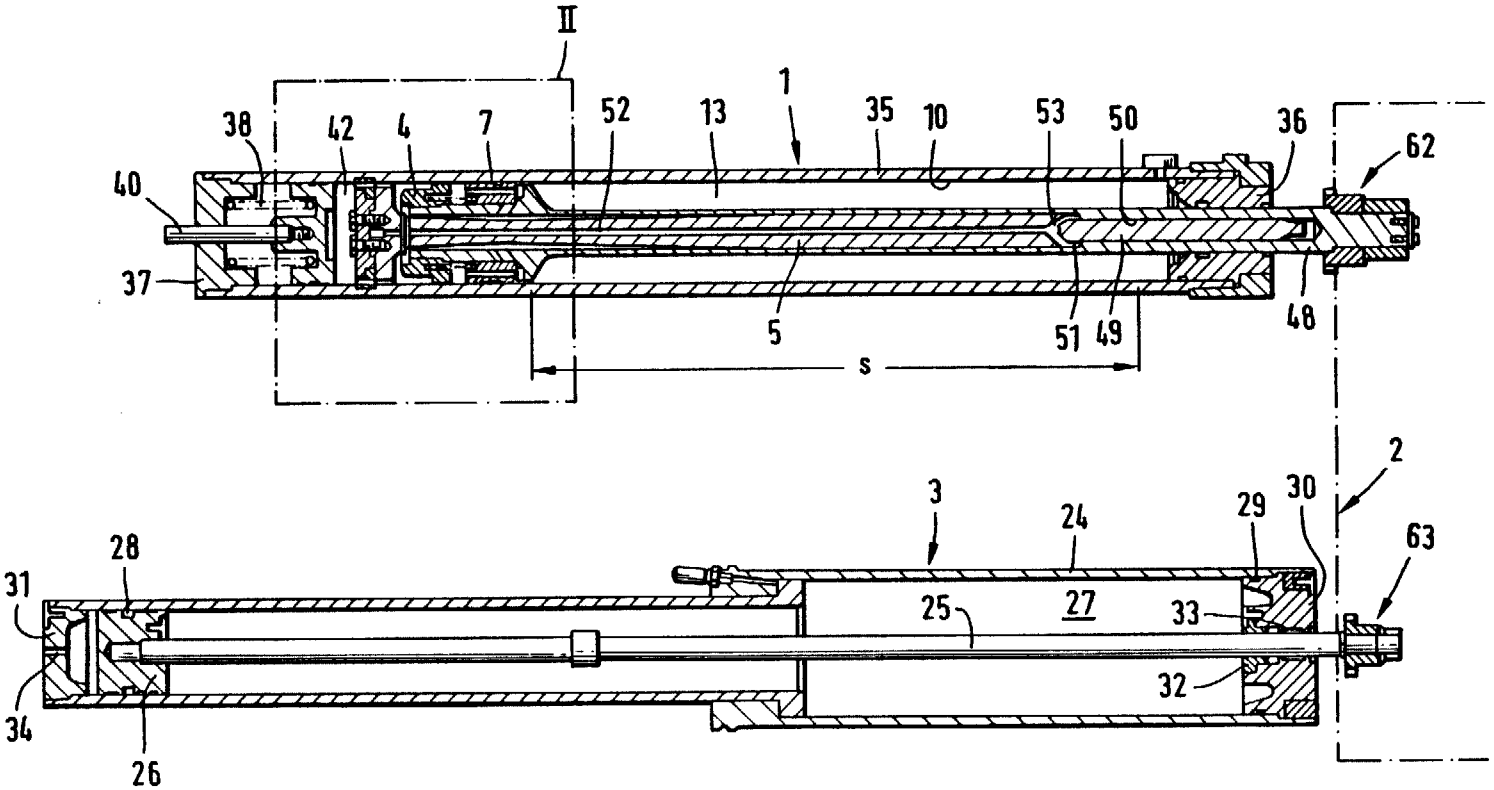
FIG. 1 is a longitudinal sectional view of a recoil brake and a recuperator connected to the breech ring of a gun barrel.

FIG. 1 illustrates on its right side the schematically illustrated breech ring 2 of a gun barrel in a gun (not shown). A recoil brake 1, on the one hand, and a recuperator 3, on the other hand, are fastened separately to breech ring 2.

Recoil brake 1 here has its brake piston rod 48 connected with breech ring 2 by way of a conventional fastening means 62 which are not here described. Recuperator 3 is fastened analogously to breech ring 2 by way of a piston rod 25 and a conventional fastening means 63 likewise not here described in detail.

The respective cylinders of recoil brake 1 and of recuperator 3 are disposed at a mantlet (not shown; see, for example, *Handbook on Weaponry*, Rheinmetall GmbH, 1982, particularly at p. 381 and FIG. 886), preferably so that the recoil brake and recuperator are diametrically opposite one another.

According to FIG. 1, recuperator 3 includes a cylinder 24 having a stepped diameter and being composed of prefabricated tubes which preferably have a smooth interior so that additional later treatment can substantially be omitted. In a manner not shown, cylinder 24 of recuperator 3 may also be composed of a single tube of unchanging diameter. At the end of piston rod 25 facing away from breech ring 2 within cylinder 24 of recuperator 3, a piston 26 is slidably arranged. Due to the relatively large pressure chamber 27 formed between piston rod 25 and the interior wall of the cylinder and preferably filled with nitrogen, the pressure gas is compressed only comparatively slightly during recoil of the gun barrel so that the increase in pressure is minimal compared to prior art recuperators and, for example, the load on sealing elements 28, 29 provided at piston 26 and at cylinder 24 is only slight.

Cylinder 24 is closed on both sides by known flanges 30, 31, with the flange associated with breech ring 2 including guides and further sealing members 32, 33 and the other flange 31 including a ventilation bore 34.

The recoil brake 1 shown in FIGS. 1 to 4 is closed off by flanges 36 and 37 respectively at opposite ends of the cylindrical jacket 35, with the flange 36 disposed on the side of the breech ring being equipped in a known manner with means for guiding and sealing the brake piston rod 48 which is connected with brake piston 4, while the flange 37 fastened to the other end of jacket 35 forms a support bearing for the spring 38 of an equilibrator (see *Handbook on Weaponry*, FIG. 927) piston 39 as disclosed in German Patent No. 1,283,706 and a guide for an indicator 40 which provides an exterior indication of the position of equilibrator piston 39. These components are essentially known and not relevant to the invention so that their detailed description is omitted for the sake of brevity.

Within brake piston 4 and brake piston rod 48, a fluid stream control rod 5 is provided which is rigidly fastened to cylinder jacket or wall 35 ahead of equilibrator piston 39. In the region where it is fastened, this control rod 5 is configured as a disc 41 so that the space formed between equilibrator piston 39 and flange 36 at the breech ring is divided into a heat compensation chamber 42 and a brake chamber 13. Both chambers 13 and 42 are connected with one another by means of at least one known compensation bore 43.

In order to fasten control rod 5, disc 41 is connected to cylindrical jacket 35, on its side facing heat equalization chamber 42, by way of a flange 45 which can be screwed on to the side of disc 41 by means of screws 44 and which, together with preferably three segments 47 distributed over the circumference and engaging formlockingly in recesses 46 of cylinder jacket 35, form a solid attachment for control rod 5 to cylinder wall 35. The segments 47 here ensure simple installation and removal of control rod 5.

Figure 2:
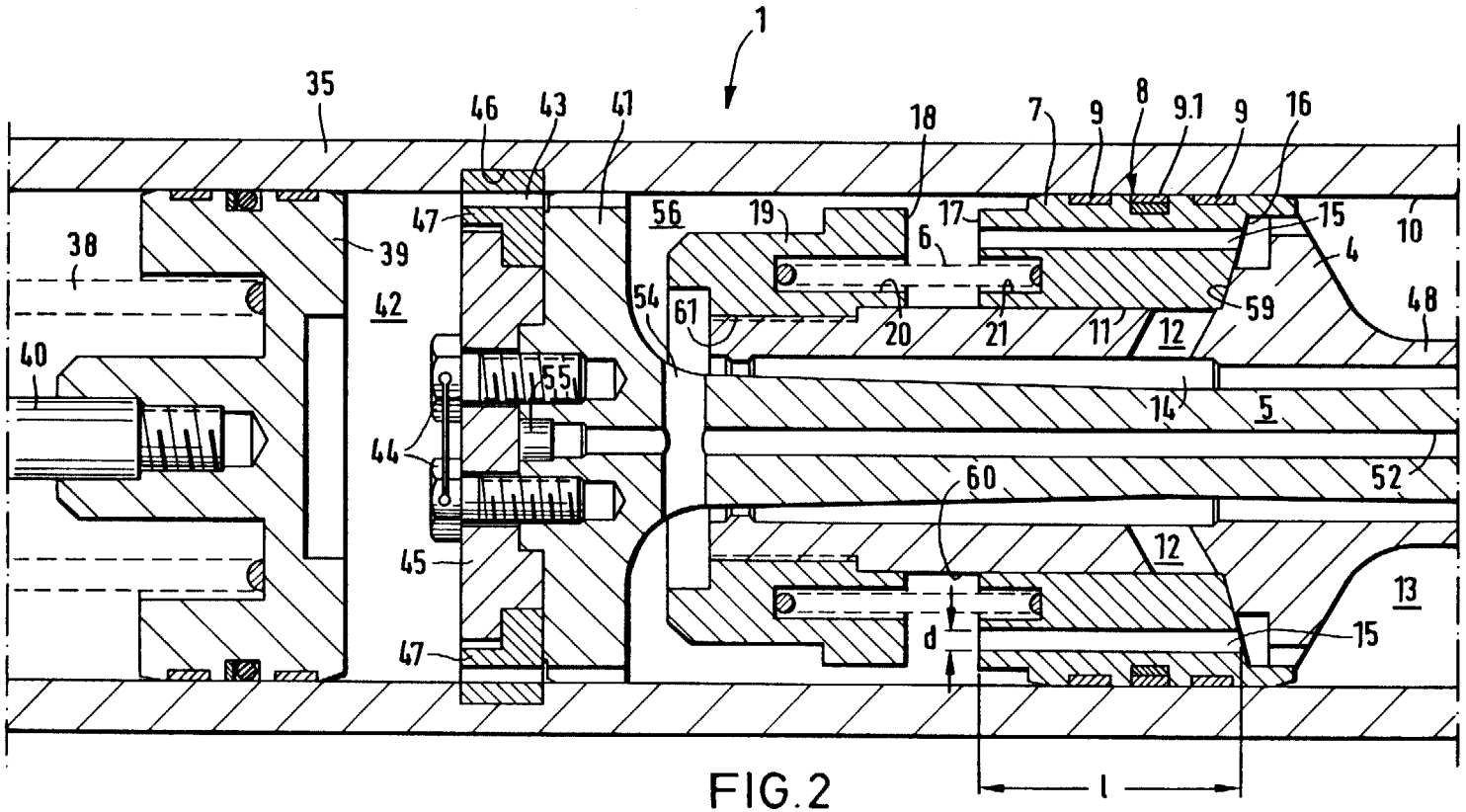
FIG. 2 is an enlarged view of a detail marked II in FIG. 1.

With part thereof projecting into brake piston 4 and into brake piston rod 48, control rod 5 forms a known throttling chamber 14 to throttle the recoil movement of the gun barrel. At its free end, control rod 5 includes, in a known manner, a counterrecoil restraining spear 49 which is provided with a longitudinal groove (not shown here) for return of the pressure fluid, with this groove opening into a counterrecoil restraining spear chamber 51. For further removal of the pressure fluid that has been pressed by counterrecoil restraining spear 49 out of bore 50 of brake piston rod 48 into counterrecoil restraining spear chamber 51, control rod 5 is provided with an axial bore 52 which, on the one hand, is connected by way of further bores 53 with counterrecoil restraining spear chamber 51 and, on the other hand, ahead of disc 41 and by way of radial bores 54, directly with a chamber 56. On the side where control rod 5 is fastened to cylinder wall 35, the outlet of axial bore 52 is, as shown in FIG. 2, closed off by a plug 55.

Brake piston 4 of recoil brake 1 includes, as medium for damping recoil and counterrecoil, a piston ring 7 which is axially displaceable against the force of a spring 6 and is configured as a blocking slide. On the one hand, during counterrecoil of the gun barrel, piston ring 7 blocks with the force of spring 6 the connecting channels 12 formed in brake piston 4 between brake chamber 13 which is formed by brake piston 4 or, more precisely, brake piston rod 48 and the interior face 10 of the brake cylinder wall 35, and a throttle chamber 14 formed jointly by brake piston 4 or, more precisely, brake piston rod 48 and control rod 5. On the other hand, piston ring 7 causes at least one bore 15 disposed within it to become effective as means for positive counterrecoil damping.

Bores 15 extend axially parallel within piston ring 7 and connect, during recoil, the brake chamber 13 lying behind the free outlets 16 of the bores with the chamber 56 which is formed between piston ring 7 and disc 41 of control rod 5. The diameter d and the length 1 of each bore 15 are here selected in such a manner that the counterrecoil velocity of the gun barrel fastened to breech ring 2 can be positively predetermined and remains approximately constant.

On its side facing away from outlets 16, piston ring 7 is provided with an end face 17 which is adapted to the preferably radially extending abutment face 18 of brake piston 4 and into which bores 15 open.

During recoil, under the effect of the brake pressure existing in brake chamber 13, the end face 17 of piston ring 7 is pressed against abutment face 18 of brake piston 4. This causes the passage of bore 15, which is open during recoil, to be interrupted at the time of braking.

Figure 3:
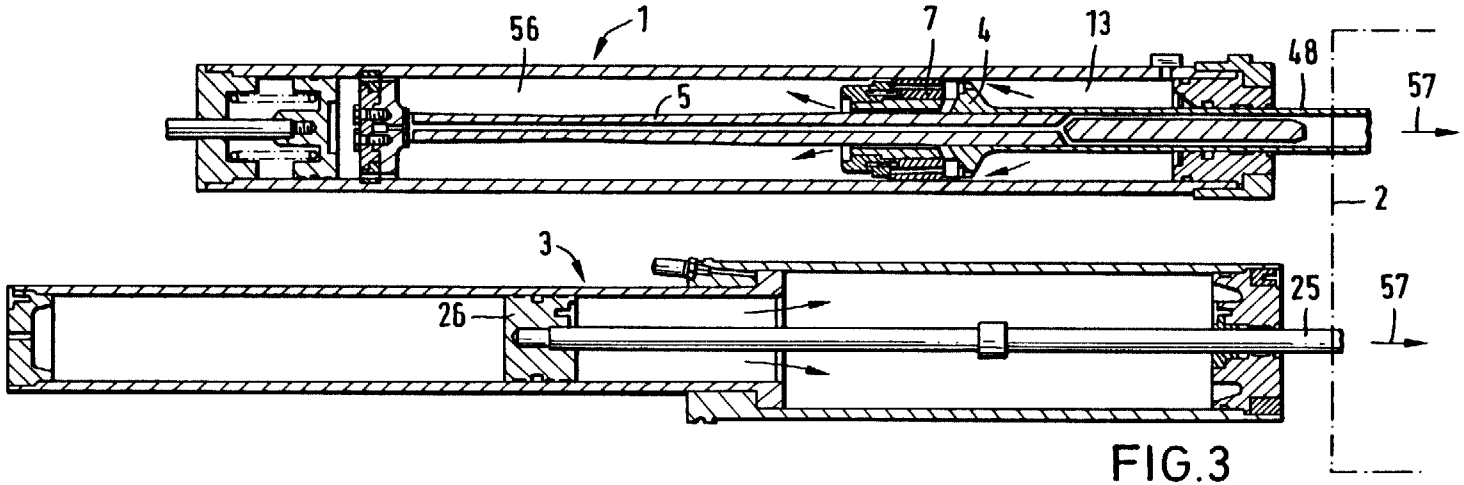
FIG. 3 shows the direction of movement of the recoil brake and of the recuperator during recoil.

FIG. 3 illustrates the position of the annular piston during recoil. Brake piston rod 48 is here pulled in the direction 57 through breech ring 2 out of recoil brake 1. This causes pressure fluid to flow as indicated by the arrows out of pressure chamber 13, through connecting channels 12 of brake piston 4 into pressure chamber 14 and from there into chamber 56, thus braking the recoil in a known manner corresponding with the throttling cross sections of control rod 5.

During recoil, piston rod 25 is likewise pulled through breech ring 2 out of the recuperator, likewise in direction 57, thus compressing by means of piston 26 the gas volume present in pressure chamber 27.

Figure 4:
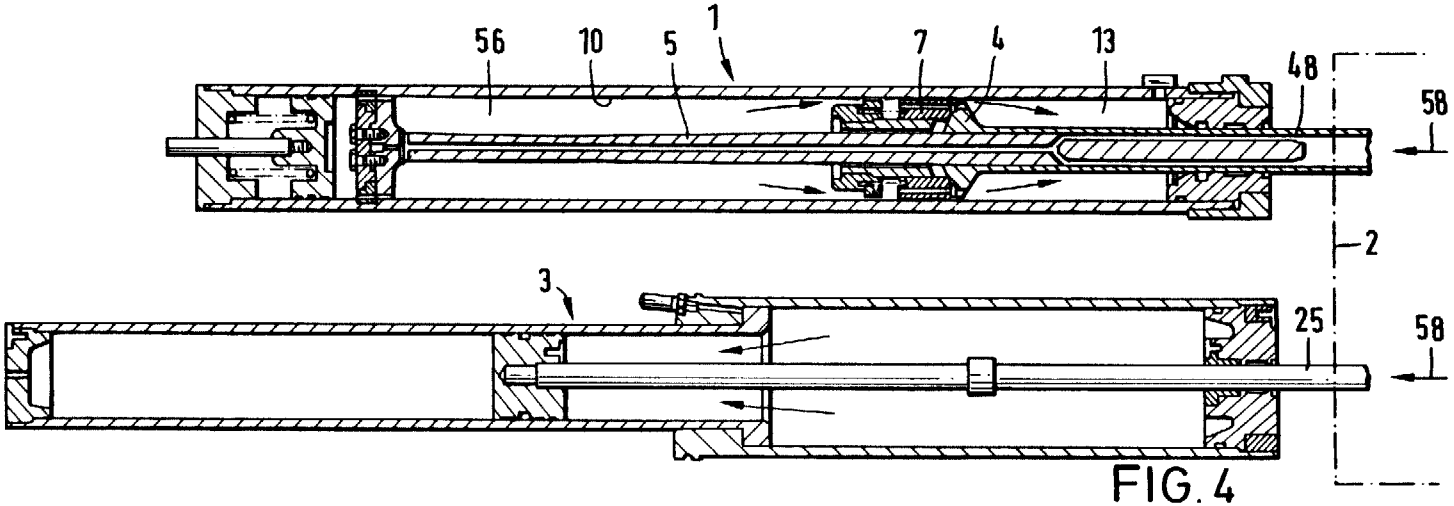
FIG. 4 shows the direction of movement of the recoil brake and of the recuperator during counterrecoil.

FIG. 4 shows the movement during counterrecoil when the expanding pressure gas pulls piston rod 25 through piston 26 into recuperator 3, thus also moving brake piston rod 48 into cylinder 35 of recoil brake 1 by way of the likewise moved breech ring 2. Before the onset of the counterrecoil movement, piston ring 7 has been displaced axially under the force of spring 6 into the position in which connecting channels 12 are closed, such position being delimited by a stop 59 provided at brake piston 4 (FIG. 2). Thus, during counterrecoil, pressure fluid flows in the direction of the arrows in FIG. 4, no longer through connecting channels 12 but, in order to realize a predetermined counterrecoil velocity, through the released bores 15 of piston ring 7 out of chamber 56 which is now under pressure and into brake chamber 13 which is pressure relieved during counterrecoil.

In order to provide a seal and realize a fast sliding movement, piston ring 7 is equipped, on its outer face 8 facing the interior face 10 of cylinder jacket 35, with low-friction and low-maintenance sealing elements 9, 9.1. On its interior, piston ring 7 has guide faces 11 in the form of a bore which slide on a cylindrical attachment-(extension) 60 to brake piston 4.

For easy installation of piston ring 7, a head 19 which accommodates the abutment face 18 for brake piston 4, is releasable fastened by means of a thread 61 to the free end of brake piston 4. For this purpose, thread 61 has a smaller diameter than attachment 60. Spring 6 which is disposed between the end face 17 of piston ring 7 and the abutment face 18 of head 19 is a compression spring and is mounted in respective grooves 20, 21 oriented in the respective axial directions in piston head 19 and in piston ring 7.

Figure 5:
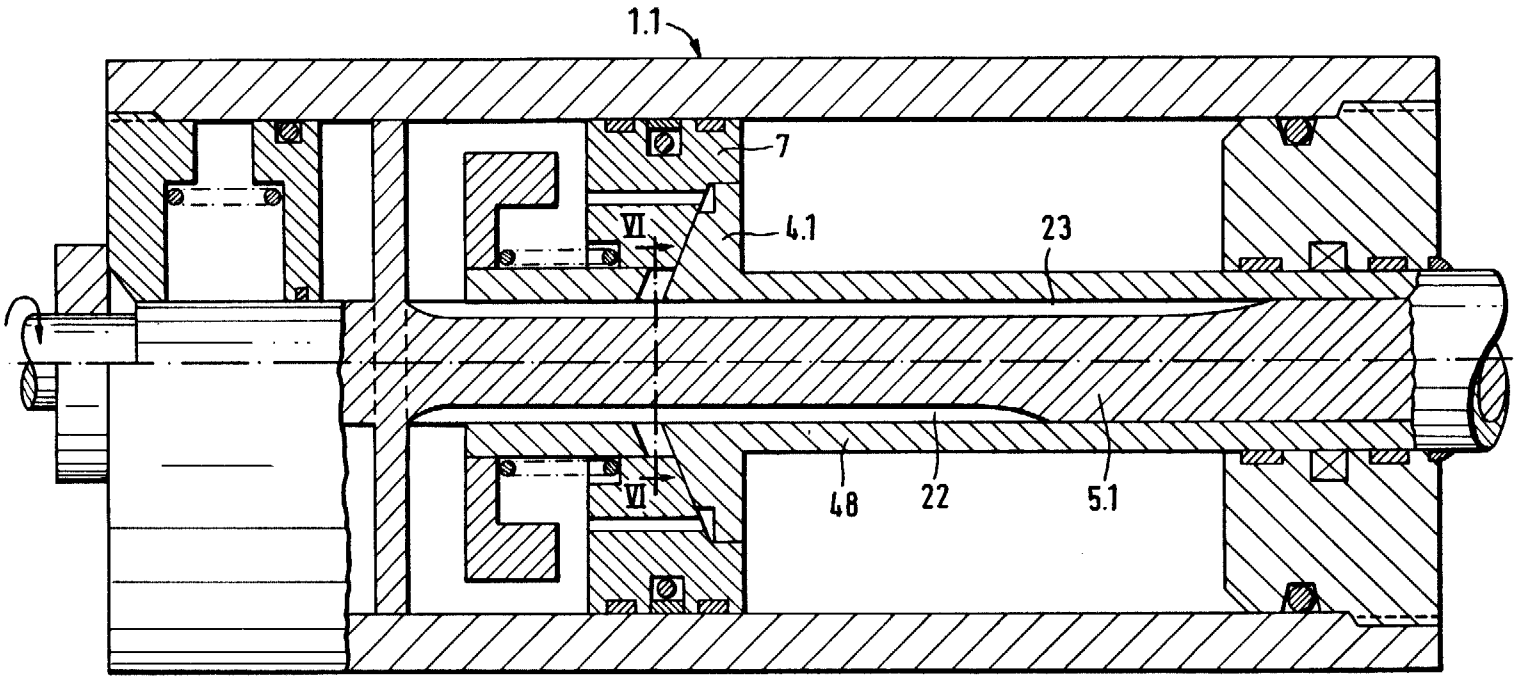
FIG. 5 is a longitudinal sectional view of a recoil brake that can be set to different recoil lengths.
Figure 6:
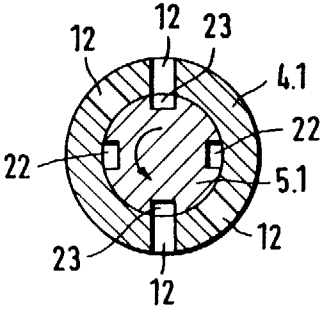
FIG. 6 is a cross-sectional view along a line marked VI—VI in FIG. 5.

In a further embodiment of the recoil brake 1.1 shown in FIGS. 5 and 6, the closable connecting channels 12 which are disposed in brake piston 4.1 inside piston ring 7 open into throttling grooves 22, 23 of control rod 5.1, with throttling grooves 22, 23 having different lengths and being rotationally adjustable, in a manner not shown in detail, from outside recoil brake 1.

Thus, the maximum recoil path of the gun barrel as indicated by an "s" in FIG. 1, can be realized by comparatively long throttling grooves 23 and a shortened recoil path can be realized by shorter throttling grooves 22. Throttling grooves 22, 23 are offset relative to connecting channels 12 in such a manner that only oppositely disposed throttling grooves 22 or 23 of the same length can be connected with connecting channels 12. The throttling rod is here fastened in a manner different from the embodiment shown in FIG. 2, namely outside of recoil brake 1.

It will be understood that the above description of the present invention is susceptible to various modifications, changes and adaptations, and the same are intended to be comprehended within the meaning and range of equivalents of the appended claims.

What is claimed is:

1. A hydraulic recoil brake for use with a pneumatic recuperator on a breech ring for a gun barrel to be jointly movable with the breech ring, the brake comprising:

an axially extending brake cylinder;

recoil and counterrecoil damping means, disposed in said brake cylinder, for damping recoil and counterrecoil of the gun barrel, said recoil and counterrecoil means including:

a first damping means for damping the recoil, including a fluid stream control rod and a brake piston reciprocally axially movable relative to said control rod, said control rod having means for resisting a flow of hydraulic fluid in said brake cylinder during recoil, a piston ring on said brake piston which is axially reciprocally displaceable relative to said brake piston between a first position and a second position, spring means for elastically urging said piston ring toward said second position, brake pressure from the hydraulic fluid urging said piston ring into said first position against the force of said spring means during recoil, said spring means urging said piston ring into said second position following recoil, said piston ring having a second damping means for damping the counterrecoil by resisting a flow of hydraulic fluid therepast when said piston ring is in said second position, and means for rendering said second damping means ineffective for damping when said piston ring is in said first position.

2. A recoil brake as in claim 1, further comprising;

a disc at one end of said fluid flow control rod, said brake cylinder having therein a heat compensation chamber bounded on a side of said disc facing away from said control rod, recesses being formed in an inner surface of said brake cylinder, segment members disposed in said recess and engaging said side of said disc, a flange member holding said segment members in said recesses, and screw means fixing said flange to said side of said disc so that said screw means, said segment members and said flange member form a screw-flange connection of said disc to said brake cylinder.

3. A recoil brake as in claim 1, wherein a brake chamber is defined between an inner surface of said brake cylinder and said brake piston, a plurality of axially extending throttling grooves being defined in said control rod, connecting channels in said brake piston providing fluid communication between said brake chamber and said throttling grooves; said brake chamber, said throttling grooves and said connecting channels forming part of said recoil and counterrecoil means; said piston ring blocking said connecting channels in said second position, the length of the throttling grooves communicating with the brake chamber by the connecting channels being adjustable.

4. A recoil brake as in claim 3, wherein the respective throttling grooves have different lengths, respective throttling grooves of different lengths being separately connectable to the brake chamber by the connecting channels.

5. A recoil brake as in claim 1, wherein said brake piston has an axially extending brake piston rod in said brake cylinder, a brake chamber being defined between an inner surface of said brake cylinder and said brake piston, a throttle chamber being defined between said brake piston and said control rod, connecting channels in said brake piston providing fluid communication between said brake chamber and said throttle chamber; said brake chamber, said throttle chamber and said connecting channels forming part of said recoil and counterrecoil means; said piston ring comprising a blocking slide which is slidable on said brake piston between said first and second positions and blocks said connecting channels in said second position; said slide blocking fluid communication between said brake chamber and said throttle chamber when said slide is in said second position for rendering said first damping means ineffective for damping when said slide is in said second position.

6. A recoil brake as in claim 5, wherein said brake piston has an abutment face facing a first end face of said slide, said second damping means including an axially extending bore in said slide opening at a first end into said first end face, said abutment face abutting said first end face so as to close said bore when said slide is in said first position and being spaced from said abutment face when said slide is in said second position, said bore having a second end communicating with said brake chamber so that hydraulic fluid is flowable through said bore when said slide is in said second position and is blocked from flowing through said bore when said slide is in said first position.

7. A recoil brake as in claim 5, further comprising;

a disc at one end of said fluid flow control rod, said brake cylinder having therein a heat compensation chamber bounded on a side of said disc facing away from said control rod, recesses being formed in an inner surface of said brake cylinder, segment members disposed in said recess and engaging said side of said disc, a flange member holding said segment members in said recesses, and screw means fixing said flange to said side of said disc so that said screw means, said segment members and said flange member form a screw-flange connection of said disc to said brake cylinder.

8. A recoil brake as in claim 1, wherein said piston ring comprises a blocking slide slidable on said brake piston between said first and second positions and blocking said connecting channels in said second position; further wherein a brake chamber is formed in said brake cylinder between an inner surface of said brake cylinder and said brake piston, said brake piston having an abutment face facing a first end face of said slide, said second damping means including an axially extending bore in said piston ring opening at a first end into said first end face, said abutment face abutting said first end face so as to close said bore when said piston ring is in said first position and being spaced from said abutment face when said piston is in said second position, said bore having a second end communicating with said brake chamber so that hydraulic fluid is flowable through said bore when said slide is in said second position and blocked from flowing through said bore when said piston ring is in said first position.

9. A recoil brake as in claim 8, wherein said bore has a uniform diameter, the magnitude of said diameter and a length of said bore determining a counterrecoil velocity of the breech ring when a weapon is fired from the gun.

10. A recoil brake as in claim 8, wherein said brake piston has a releasable head mounted thereon, said abutment face being formed on said head.

11. A recoil brake as in claim 10, wherein abutment face and said first end face have respective opposing circular ring shaped grooves, said spring means including a compression spring having opposite ends respectively supported in said opposing grooves.

12. A gun barrel recoil brake arrangement, comprising:

a breech ring for a gun barrel; and a pneumatic recuperator and a hydraulic recoil brake mounted on said breech ring so as to be jointly movable therewith, said brake including an axially extending brake cylinder fixed to said breech ring and having therein recoil and counterrecoil damping means for damping recoil and counterrecoil of the gun barrel, said recoil and counterrecoil means including:

a first damping means for damping the recoil, including a fluid stream control rod and a brake piston reciprocally axially movable relative to said control rod, said control rod having means for resisting a flow of hydraulic fluid in said brake cylinder therepast during recoil, a piston ring in said brake piston which is axially reciprocally displaceable relative to said brake piston between a first position and a second position, spring means for elastically urging said piston ring toward said second position, brake pressure from the hydraulic fluid urging said piston ring into said first position against the force of said spring means during recoil, said spring means urging said piston ring into said second position following recoil, said piston ring having a second damping means for damping the counterrecoil by resisting a flow of hydraulic fluid therepast when said piston ring is in said second position, and means for rendering said second damping means ineffective for damping when said piston ring is in said first position.

13. An arrangement as in claim 12, wherein said recuperator comprises an axially extending recuperator cylinder, an axially extending recuperator piston rod having a recuperator piston at one end thereof, axially movable in said recuperator cylinder, a closed end of said recuperator cylinder, said recuperator piston and an inner surface of said recuperator cylinder bounding a pressure chamber surrounding the recuperator piston rod so that said recuperator piston is guided in said recuperator cylinder against a compressed gas in said pressure chamber.

14. An arrangement as defined in claim 13, wherein the recuperator cylinder has a uniform diameter.

15. An arrangement as defined in claim 13, wherein the recuperator cylinder has a stepped diameter.

16. A hydraulic recoil brake for use with a pneumatic recuperator on a breech ring for a gun barrel to be jointly movable with said breech ring, the brake comprising:

an axially extending brake cylinder; and recoil and counterrecoil damping means, disposed in said brake cylinder, for damping recoil and counterrecoil of the gun barrel, said recoil and counterrecoil means including:

a first damping means for damping the recoil, including an axially extending fluid stream control rod fixed with respect to said brake cylinder, and a brake piston having a brake piston rod, reciprocally axially movable relative to said control rod, said control rod having means for resisting a flow of hydraulic fluid in said brake cylinder therepast during axial movement in a first axial direction relative thereto of said brake piston accompanying recoil, a piston ring on said brake piston which is axially reciprocally displaceable relative to said brake piston between a first position and a second position;

spring means for elastically urging said piston ring toward said second position, brake pressure from the hydraulic fluid urging said piston ring into said first position against the force of said spring means during recoil, said spring means urging said piston ring into said second position following recoil, said piston ring having a second damping means for damping the counterrecoil by resisting a flow of hydraulic fluid therepast when said brake piston is moving in a second axial direction opposite said first axial direction and said piston ring is in said second position, and means for rendering said second damping means ineffective for damping when said piston ring is in said first position.

17. A recoil brake as in claim 16, wherein a brake chamber is defined between an inner surface of said brake cylinder and said brake piston rod, said brake piston rod surrounding said control rod, an axially extending throttle chamber being defined between said brake piston rod and said control rod, connecting channels in said brake piston providing fluid communication between said brake chamber and said throttling chamber; said brake chamber, said throttle chamber and said connecting channels forming part of said recoil and counterrecoil means; said piston ring comprising a blocking slide which is slidable on said brake piston between said first and second positions and blocks said connecting channels in said second position, thereby rendering said first damping means ineffective for damping when said slide is in said second position.

18. A recoil brake as in claim 17, wherein said brake piston has an abutment face facing a first end face of said slide, said second damping means including an axially extending bore in said slide opening at a first end into said first end face, said abutment face abutting said first end face so as to close said bore when said slide is in said first position and being spaced from said abutment face when said slide is in said second position, said bore having a second end communicating with said brake chamber so that hydraulic fluid is flowable through said bore when said slide is in said second position and blocked from flowing through said bore when said slide is in said first position.

* * * * *